US008961712B2

(12) United States Patent
Hayakawa et al.

(10) Patent No.: US 8,961,712 B2
(45) Date of Patent: Feb. 24, 2015

(54) RARE EARTH BASED SINTERED MAGNET

(75) Inventors: Takuma Hayakawa, Tokyo (JP); Ryota Kunieda, Tokyo (JP); Tetsuya Chiba, Tokyo (JP); Kenichi Nishikawa, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 14/360,452

(22) PCT Filed: Aug. 2, 2012

(86) PCT No.: PCT/JP2012/069644

§ 371 (c)(1),
(2), (4) Date: May 23, 2014

(87) PCT Pub. No.: WO2013/080605

PCT Pub. Date: Jun. 6, 2013

(65) Prior Publication Data

US 2014/0318316 A1 Oct. 30, 2014

(30) Foreign Application Priority Data

Nov. 29, 2011 (JP) ..... 2011-260359
Jul. 23, 2012 (JP) ..... 2012-162660

(51) Int. Cl.
*H01F 1/057* (2006.01)
*H01F 1/053* (2006.01)
(Continued)

(52) U.S. Cl.
CPC ..... *H01F 1/0536* (2013.01); *B22F 3/00* (2013.01); *B22F 3/02* (2013.01); *B22F 3/10* (2013.01);
(Continued)

(58) Field of Classification Search
CPC ..... H01F 1/0536
USPC ..... 148/101, 301, 302; 75/246
See application file for complete search history.

(56) References Cited

U.S. PATENT DOCUMENTS 5,167,914 A * 12/1992 Fujimura et al. ..... 419/11
6,468,365 B1 * 10/2002 Uchida et al. ..... 148/302
2010/0003156 A1 1/2010 Suzuki et al.

FOREIGN PATENT DOCUMENTS

JP A-63-93841 4/1988
JP A-9-232173 9/1997
(Continued)

OTHER PUBLICATIONS

Translation of Office Action issued in Japanese Application No. 2012-162660 issued Feb. 26, 2013.
(Continued)

*Primary Examiner* — George Wyszomierski
*Assistant Examiner* — Ngoclan T Mai
(74) *Attorney, Agent, or Firm* — Oliff PLC

(57) ABSTRACT

The present invention provides a rare earth based sintered magnet. The magnet is a rare earth based permanent magnet with a R-T-B (R represents one or more elements selected from Y and rare earth elements, T represents one or more metal elements including Fe or the combination of Fe and Co, and B represents B or the combination of B and C) based composition. When a R-rich phase (R represents rare earth element(s)) with atomic ratio of (Fe+Co)/(LR+HR+Fe+Co) ≤0.2 (LR represents Y and light rare earth element(s) selected from $^{57}$La to $^{63}$Eu, and HR represents heavy rare earth element(s) selected from $^{64}$Gd to $^{71}$Lu) is present in the grain boundary triple point, a region with HR/(LR+HR)≥0.01 (atomic ratio) is present in the R-rich phase, and the region with HR/(LR+HR)≥0.01 accounts for 10% to 90% of the area of the grain boundary triple point.

4 Claims, 3 Drawing Sheets

(51) Int. Cl.

| | |
|---|---|
| ***B22F 3/00*** | (2006.01) |
| ***B22F 3/02*** | (2006.01) |
| ***B22F 3/10*** | (2006.01) |
| ***B22F 3/24*** | (2006.01) |
| ***C22C 33/02*** | (2006.01) |
| ***C22C 38/00*** | (2006.01) |
| ***C22C 38/02*** | (2006.01) |
| ***C22C 38/10*** | (2006.01) |
| ***C22C 38/16*** | (2006.01) |
| ***B22F 9/02*** | (2006.01) |
| ***C22C 1/10*** | (2006.01) |
| *B22F 9/04* | (2006.01) |
| *H01F 41/02* | (2006.01) |

(52) U.S. Cl.

CPC . *B22F 3/24* (2013.01); *C22C 33/02* (2013.01); *C22C 38/00* (2013.01); *C22C 38/002* (2013.01); *C22C 38/005* (2013.01); *C22C 38/02* (2013.01); *C22C 38/10* (2013.01); *C22C 38/16* (2013.01); *B22F 9/023* (2013.01); *C22C 1/1094* (2013.01); *C22C 33/0278* (2013.01); *H01F 1/0577* (2013.01); *B22F 2009/044* (2013.01); *H01F 41/0293* (2013.01)

USPC ..... 148/302; 75/246

(56) References Cited

FOREIGN PATENT DOCUMENTS

| | | |
|---|---|---|
| JP | A-2003-31409 | 1/2003 |
| JP | A-2010-263172 | 11/2010 |
| JP | A-2011-187734 | 9/2011 |

OTHER PUBLICATIONS

International Search Report issued in International Application No. PCT/JP2012/069644 mailed Nov. 6, 2012.

Partial English translation of Written Opinion of the International Searching Authority issued in International Application No. PCT/JP2012/069644 mailed Nov. 6, 2012.

* cited by examiner

RARE EARTH BASED SINTERED MAGNET

The present invention relates to a rare earth based sintered magnet with its corrosion resistance improved.

BACKGROUND

The rare earth based permanent magnet with a R-T-B (R represents one or more elements selected from the group consisting of Y and rare earth elements, T represents one or more metal elements containing Fe or the combination of Fe and Co, and B represents B or the combination of B and C) based composition is well known as a permanent magnet which has $R_2T_{14}B$ as the main phase, includes structure containing the grain boundary phase and has excellent magnetic properties such as a high energy product BHmax and the like, wherein the grain boundary phase contains a R-rich phase which contains more amount of R than the main phase. The R-T-B based rare earth based permanent magnet is used as a permanent magnet with good performances in motors which particularly require good performances, such as a voice-coil motor for head driving in hard disk drive or a motor in a electric vehicle, a hybrid car or the like.

Since the rare earth based permanent magnet contains a high amount of R which is highly active and R corrodes easily and has a bad corrosion resistance, the corrosion resistance can be improved by plating Ni on the surface of the rare earth based magnet to inhibit the corrosion starting from the surface.

With respect to the improvement of the corrosion resistance of the rare earth based permanent magnet body, it has been attempted to improve the corrosion resistance of the magnet body by adding elements such as Co or Cu or the like.

In the prior art, a rare earth based sintered magnet has been provided that an intermediate phase with good oxidation resistance and containing 30 atom % to 60 atom % of Co and Cu in total is set up by surrounding the R-rich phase which is present in the grain boundary triple point surrounded by three or more main phases. And thus, the oxidation of R components in the R-rich phase can be inhibited at the grain boundary triple point and the corrosion resistance can be improved accordingly (for example, see Patent Document 1).

PATENT DOCUMENT

Patent Document 1: JP2003-31409

SUMMARY

However, the following problem exists. When the intermediate phase does not cover the whole R-rich phase in the grain boundary triple point and pinholes exist in the intermediate phase, since many R-rich phases with low corrosion resistance exist in the grain boundary triple point, the oxidation of R components in R-rich phases proceeds from the pinholes towards the inside of the triple point, and thus the corrosion to the whole magnet body cannot be sufficiently inhibited.

In recent years, the use of rare earth based magnet in vehicles or industrial devices is increasing, so rare earth based sintered magnets having better corrosion resistance are desired.

The present invention is achieved by recognizing the above-mentioned situation. The objective of the present invention is to provide a rare earth based sintered magnet with corrosion resistance improved.

In order to achieve the above-mentioned objective, studies had been conducted by the inventors. As a result, it is found that, in the R-rich phases with a predetermined composition at the grain boundary triple points which are easier to corrode than the main phase that is the $R_2Fe_{14}B$ phase of the R-T-B based sintered magnet, when HR (HR represents one or more elements selected from the heavy rare earth elements from $^{64}$Gd to $^{71}$Lu) in R-rich phases is contained with a specified ratio or more relative to the total amount of R components i.e., LR and HR (LR represents one or more elements selected from the group consisting of Y and light rare earth elements from $^{57}$La to $^{63}$Eu) Eu) n the R-rich phases, R-rich phases with a higher corrosion potential are formed and they are difficult to corrode compared to the case that the ratio of HR is less than the above-mentioned one.

In addition, it has been seen that the magnetic properties would not be reduced and the corrosion resistance could be improved by setting the area ratio of R-rich phases mentioned above to the grain boundary triple points as a specified value and setting CV values (obtained by dividing the standard deviation of all analysis points by the arithmetic mean of all analysis points) of the detection signal of HR obtained by EPMA in the visual filed excluding the 50 μm part of the surface layer of the magnet as a specified value.

The rare earth based sintered magnet in the present invention is characterized in that it has a R-T-B (R represents one or more elements selected from the group consisting of Y and rare earth elements, T represents one or more metal elements containing Fe or the combination of Fe and Co, and B represents B or the combination of B and C) based composition, and when the R-rich phases with (Fe+Co)/(LR+HR+Fe+Co) ≤0.2 (LR represents one or more elements selected from the group consisting of Y and light rare earth elements from $^{57}$La to $^{63}$Eu, and HR represents one or more elements selected from the heavy rare earth elements from $^{64}$Gd to $^{71}$Lu) according to atomic ratio are present in the grain boundary triple points, regions with HR/(LR+HR)≥0.01 (atomic ratio) are present in the R-rich phases and account for 10% to 90% of the grain boundary triple points based on area ratio.

Further, the rare earth based magnet of the present invention is characterized in that, when it is observed via EPMA within a visual field of 10-100 μm×10-100 μm, the CV value (obtained by dividing the standard deviation of all analysis points by the arithmetic mean of all analysis points) of the detection signal of HR in the visual filed excluding the 50 μm part of the surface layer of the magnet ranges from 0.15 to 0.5.

In the rare earth based sintered magnet of the present invention, it is preferable that LR at least contains Nd or Pr, and HR at least contains Dy or Tb. Thus, good magnetic properties can be obtained by setting LR and HR as mentioned above.

In addition, it is preferable in the rare earth based sintered magnet of the present invention that the content of R is 25 mass % or more and 35 mass % or less. Thus, good magnetic properties can be brought out by setting the content of R in this range.

Further, in the rare earth based sintered magnet of the present invention, it is preferable that the content of B is 0.9 mass % or more and 1.1 mass % or less. Good magnetic properties can be obtained by setting the content of B in this range.

According to the present invention, a rare earth based sintered magnet is provided with good magnetic properties maintained and corrosion resistance improved.

DETAILED DESCRIPTION OF EMBODIMENTS

Hereinafter, the preferable embodiments of the present invention will be described. In addition, the present invention will not be limited to the disclosure of the following embodiments and examples. Further, the constituent elements shown in the following embodiments and examples can be appropriately combined or selected to use.

<Rare Earth Based Sintered Magnet>

The rare earth based sintered magnet of the present embodiment is a sintered body formed by R-T-B based alloys.

The rare earth based sintered magnet according to the present embodiment contains the main phase (crystal grain) which is $R_2Fe_{14}B$, the grain boundary phase having more content of R than the main phase, and the grain boundary triple point surrounded by three or more main phases. At the grain boundary triple point, a R-rich phase with (Fe+Co)/(LR+HR+Fe+Co)≤0.2 based on atomic ratio and more preferable (Fe+Co)/(LR+HR+Fe+Co)≤0.1 is present. When (Fe+Co)/(LR+HR+Fe+Co)>0.2, a magnetic phase composed of R-rich Fe and/or Co is formed at the grain boundary triple point. Thus, the magnetic separation among the main phases becomes insufficient, which may reduce the coercivity (HcJ). As the R-rich phase inevitably contains Fe and/or Co, (Fe+Co)/(LR+HR+Fe+Co) will not be 0.

In the R-rich phase of the present embodiment, a region with the composition of being HR/(LR+HR)≥0.01 according to atomic ratio is present, preferably HR/(LR+HR)≥0.03, and more preferably HR/(LR+HR)≥0.05. In the case of HR/(LR+HR)≥0.01, the corrosion potential of the R-rich phase increases and the corrosion resistance of the whole magnet is improved by elevating the amount of HR in the R-rich phase. The upper limit for HR/(LR+HR) is not particularly limited because a large atomic ratio will not bring bad influence on the corrosion resistance and the magnetic properties.

In addition, the region in the R-rich phase with HR/(LR+HR)≥0.01 (atomic ratio) accounts for 10% to 90%, preferably 15% to 85% and more preferably 20% to 80% of the grain boundary triple point based on area ratio. If the area ratio is less than 10%, the effect of improving the corrosion resistance of the magnet body will not be sufficiently brought out. If the area ratio is larger than 90%, the R-rich phase is more likely to contact with the surface of the main phase, which may render HR to diffuse towards the inside of the main phase due to volume diffusion so that the residual flux density Br may be reduced.

Figure 1:
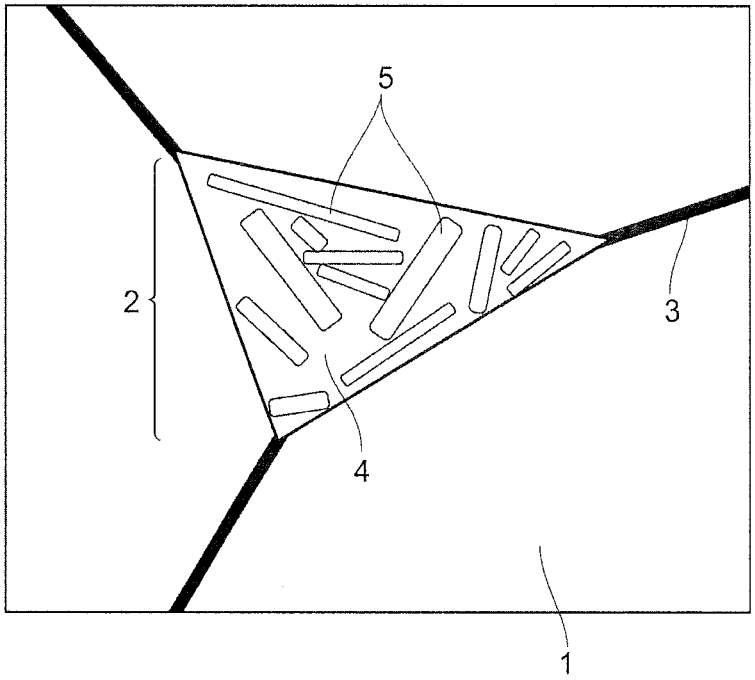
FIG. 1 is a pattern drawing showing the surroundings of the grain boundary triple point in the rare earth based sintered magnet according to the present embodiment.

FIG. 1 is a pattern drawing showing the surroundings of the grain boundary triple point in the rare earth based sintered magnet according to the present embodiment. In FIG. 1, 1 represents the main phase, 2 represents the grain boundary triple point, 3 represents the grain boundary phase, 4 represents the R-rich phase and 5 represents the HR-rich phase. When the R-rich phase with the composition of (Fe+Co)/(LR+HR+Fe+Co)≤0.2 and HR/(LR+HR)≥0.01 based on atomic ratio is called the HR-rich phase, the R-rich phase and the HR-rich phase are both present at the grain boundary triple point, suggesting that the HR-rich phase accounts for 10% to 90% of the area of the grain boundary triple point. Meanwhile, although not being shown in the figure, inevitable impurities such as B-rich phases with a lot of B and the like are contained in the grain boundary triple points.

Figure 2:
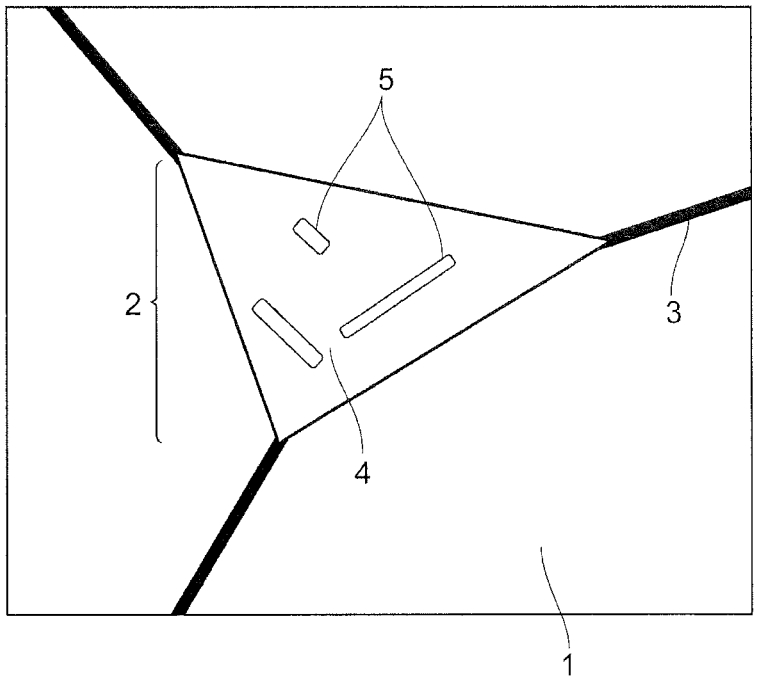
FIG. 2 is a pattern drawing showing the surroundings of the grain boundary triple point in a conventional rare earth based sintered magnet.

FIG. 2 is a pattern drawing showing the surroundings of the grain boundary triple point in a conventional rare earth based sintered magnet. Meanwhile, the symbols represent the same meaning as in FIG. 1. Compared to the rare earth based sintered magnet according to the present embodiment shown in FIG. 1, the area occupied by the HR-rich phase is quite small in the grain boundary triple point of the conventional rare earth based sintered magnet shown in FIG. 2, which may be the reason why the corrosion resistance and the magnetic properties reduce.

Further, when the magnet is observed via EPMA with a visual field of 10-100 μm×10-100 μm, the CV value (obtained by dividing the standard deviation of all analysis points by the arithmetic mean of all analysis points) of the detection signal of HR in the visual filed excluding the 50 μm part of the surface layer of the magnet ranges from 0.15 to 0.5, preferably 0.175 to 0.45 and more preferably 0.2 to 0.4. If the CV value falls within the ranges, the corrosion resistance can be improved while the magnetic properties will not deteriorate. If the CV value is less than 0.15, HR homogeneously distributes in the whole magnet including the main phases so that the corrosion resistance cannot be sufficiently improved. If the CV value is larger than 0.5, HR is only present in a small region of the R-rich phase due to the excessive segregation, and thus the corrosion resistance and magnetic properties cannot be sufficiently brought out. The 50 μm part of the surface layer is excluded because a correct CV value may not be calculated for the rare earth based sintered magnet since the visual field is not big enough to accommodate the whole rare earth based sintered magnet if the 50 μm part of the surface layer is included in the visual field.

In the rare earth based sintered magnet of the present embodiment, it is preferable that LR at least contains Nd or Pr, and HR at least contains Dy or Tb. When LR of the present invention contains Nd or Pr, a large Br can be obtained. If HR of the present invention contains Dy or Tb, a large HcJ can be achieved.

In the present embodiment, R represents one or more elements selected from the group consisting of Y and rare earth elements. The rare earth elements include La, Ce, Pr, Nd, Sm, Eu, Gd, Tb, Dy, Ho, Er, Tm, Yb and Lu. The rare earth elements are divided into the light rare earth elements LR and heavy rare earth elements HR. The heavy rare earth elements refer to Gd, Tb, Dy, Ho, Er, Tm, Yb, Lu, and the light rare earth elements refer to the rare earth elements except the above-mentioned ones. In the present embodiment, the content of R in the rare earth based sintered magnet is preferably 25 mass % or more and 35 mass % or less, and more preferably 28 mass % or more and 33 mass % or less. By setting the content of R at the above ranges, the surroundings of the main phase are covered by the R-rich grain boundaries and the grain boundary triple points, and thus the sufficient coercivity HcJ can be brought out.

In the present embodiment, T represents one or more elements containing Fe or the combination of Fe and Co. When part of Fe is replaced with Co, the temperature properties can be improved while the magnetic properties will not be impaired. Besides Fe and Co, T can further include at least one element selected from Al, Si, Ti, V, Cr, Mn, Ni, Cu, Zn, Ga, Zr, Nb, Mo, Ag, Sn, Hf, Ta, W, Au, Bi and the like.

In the present embodiment, B represents B or the combination of B and C. The content of B in the rare earth based sintered magnet of the present embodiment is preferably 0.9 mass % or more and 1.1 mass % or less, and more preferably 0.95 mass % or more and 1.05 mass % or less. By setting the content of B at the ranges, the volume ratio of the main phases may be increased and a large Br can be achieved.

In the present embodiment, T is contained as the balance besides R and B.

<Method for Producing the Rare Earth Based Sintered Magnet>

The preferred methods for producing the rare earth based sintered magnet having the structure shown above are described by using the drawings.

In the present embodiment, the first alloy and the second alloy are prepared firstly. The first alloy is an alloy containing R-T-B based compounds, and contains HR and LR. In the first alloy, based on the whole alloy, LR is contained at an amount of 15 mass % or more and 36 mass % or less, and HR is contained at an amount of 0 mass % or more and 21 mass % or less. Further, the content of B in the first alloy is 0.9 mass % or more and 1.2 mass % or less. In addition, T is contained in the first alloy as the balance besides HR, LR and B. The second alloy contains HR as the essential and further contains one element selected from the group consisting of Al, Si, Ti, V, Cr, Mn, Ni, Cu, Zn, Ga, Zr, Nb, Mo, Ag, Sn, Hf, Ta, W, Au and Bi. HR is contained in the second alloy at an amount of 30 mass % or more and 95 mass % or less. The HR in the second alloy is preferably Dy or Tb. Specifically, the examples of the second alloy can be Dy—Cu compound, Dy—Al compound, Tb—Cu compound, Tb—Al compound and the like. The target structure of the grain boundary triple point can be obtained by making the compositions of the first and second alloys to be those described above. This is because the first alloy forms $R_2Fe_{14}B$ phase as the main phase and the second alloy which contains more amount of HR than the first alloy forms the grain boundary triple point, and thus a target R-rich phase can be formed at the grain boundary triple point. Based on such a viewpoint, the content of HR in the second alloy is preferably 70 mass % or more, and more preferably 85 mass % or more.

The difference between the liquid-phase generating temperature of the second alloy and that of the first alloy is preferably 300° C. or less, and more preferably 200° C. or less. If the difference between the two liquid-phase generating temperatures falls within this range, the target structure of the grain boundary triple points tends to be easily obtained. The reason is shown as follows. If the two liquid-phase generating temperatures are close, both the first alloy and the second alloy become easy to produce liquid phase during heat treatments such as the sintering process or the aging treatment or the like. Thus, the generated liquid phases are mixed at the grain boundary triple point. In addition, the remaining melted part of the second alloy is unevenly distributed in the grain boundary triple point, and thus a target R-rich phase with a desired area ratio will be easily formed.

The raw alloy can be prepared by a method such as an ingot casting method, a strip casting method, a book molding method, a centrifugal casting method or the like after the raw metals are melted in vacuum or an inert atmosphere such as Ar gas atmosphere and the like. If solidification and segregation occur in the resultant raw alloy, a homogenization treatment can be conducted for 1 hour or more at a temperature of 700° C. to 1500° C. in an inert atmosphere.

In order to improve the magnetic properties of the finally obtained rare earth based sintered magnet, the atmosphere with a low oxygen concentration is preferably provided throughout the steps described as follows from pulverization to sintering. The concentration of oxygen in each step is preferably adjusted to 3000 ppm or less.

The first and second raw alloys obtained in the above embodiments are pulverized to particles with a particle size of about several hundred micrometers. A coarse pulverizer is used under an inert atmosphere, such as a BRAUN mill, a stamp mill, a jaw crusher and the like. Alternatively, hydrogen adsorption pulverization also can be performed in which hydrogen is adsorbed to the raw alloy and then cracks caused by cubical expansion are generated to pulverize alloys. And the first and the second alloys can be pulverized together. However, it is preferred to pulverize the two alloys separately in view of inhibiting the composition deviation.

Subsequently, the powders obtained by the coarse pulverization are finely pulverized until a particle size is about several micrometers. The finely pulverized powders are obtained by using a fine pulverizer such as a ball mill, a vibration mill, a wet attritor, a jet mill and the like to pulverize the coarsely pulverized powders under an inert atmosphere. Before the fine pulverization, a grinding aid can be added such as zinc stearate, oleic amide or the like. In this case, finely pulverized powders with high orientation can be obtained during molding.

The powders of the first and second alloys obtained by the fine pulverization step are mixed under a low-oxygen atmosphere. Such a low-oxygen atmosphere consists of an inert gas such as nitrogen gas ($N_2$), Ar gas and the like. The mixture ratio of the second alloy powders to the first alloy powders is 0.1 mass % or more and 0.4 mass % or less. This is because the target R-rich phase with a desired composition ratio can be achieved by adjusting the ratio of the second alloy. Based on this, the mixture ratio of the second alloy powders to the first alloy powders is preferably 0.2 mass % or more and 0.35 mass % or less. If the mixture ratio is at the above-mentioned range, the corrosion resistance can be improved and the magnetic properties can be maintained. In addition, in the case that the first alloy and the second alloy are mixed before the pulverization step and then the powders of the first and the second alloys are pulverized together, the mixture ratio is also preferred to be within the range mentioned above.

Next, the obtained raw powders are molded into a target predetermined shape. The molding is performed while the magnetic field is applied so that the raw material powders are oriented in a predetermined direction. Thus, an anisotropic rare earth based sintered magnet with a larger residual flux density Br can be obtained by the magnet oriented in a specified direction. The molding can be conducted by press molding and the like. The shape of the molded body obtained by applying a pressure to the raw material powders is not particularly limited. Based on the shape of the desired rare earth based sintered magnet such as a tabular shape, a columnar shape, a shape with the cross-section being ring-shaped and the like, the shape of the mold in use vary accordingly. The molding is preferably performed in a magnetic field of 0.9 MA/m or more under a pressure of about 70 MPa to 200 MPa. The applied magnetic field is not limited to a static magnetic field, and it also can be a pulsed magnetic field or the combination of a static magnetic field and a pulsed magnetic field. Further, as the molding method, a dry molding in which the raw material powders are directly molded can be adopted; besides, a wet molding in which the slurry obtained by dispersing the raw powders in a solvent such as oil and the like is molded also can be used.

Then, the molded body is sintered in vacuum or an inert atmosphere. It is necessary to adjust the sintering temperature according to the conditions such as the composition, pulverization method, the grain size and the grain size distribution. For example, the sintering process is performed for 1 hour or more and 10 hours or less at a temperature of 900° C. or more and 1200° C. or less. In this way, a molded body can be obtained.

Thereafter, the obtained sintered body is heat treated at a temperature lower than the sintering temperature to perform an aging treatment. The treatment is provided to adjust the magnetic properties of the finally obtained rare earth based sintered magnet by adjusting the structure of the sintered body. The aging treatment is conducted in vacuum or an inert atmosphere, for example, for 30 minutes to 180 minutes at 400° C. to 650° C. Further, Ha can be further improved compared to a one-stage heating if a two-stage heating is employed for the aging treatment. Thus, the two-stage heating is preferable. If the two-stage heating is used for the aging treatment, the temperature in the first stage can be higher than that of the second stage. For example, heating at the first stage is conducted at 650□ to 950□ for 30 minutes to 180 minutes.

After the aging treatment, the sintered body is cut into a desired size as needed, or it can be further processed or subjected to a surface treatment. Thus, the target rare earth based sintered magnet can be obtained. Further, a protection layer such as a plated layer, an oxidization layer, a resin layer or the like can be further provided in order to improve the corrosion resistance of the surfaces in the obtained rare earth based sintered magnet.

EXAMPLE

Hereinafter, the present invention will be described in detail based on the Examples and Comparative Examples. However, the present invention is not limited to the following Examples.

<Production of the Rare Earth Based Sintered Magnet>

Example 1

The first alloy 1 and the second alloy 1 with the composition listed in Table 1 were used to produce the magnets with the compositions shown in Table 1 by a strip casting method. The alloy with the Dy—Cu based composition was chosen as the second alloy. After the mixture of the first alloy 1 and the second alloy 1 was subjected to the hydrogen-adsorbing treatment at room temperature, a dehydrogenation treatment was conducted in Ar atmosphere at 600° C. for 1 hour, and then the first alloy 1 and the second alloy 1 were coarsely pulverized. 0.05 mass % of oleic amide relative to the coarsely pulverized powders was added as a grinding aid into the coarsely pulverized first alloy 1 and the second alloy 1. The fine pulverization was performed by a jet mill to obtain fine powders with an average particle size of 4.0 μm. The obtained first alloy powders and second alloy powders were mixed to be a mass ratio of 99.7 to 0.3 under a low-oxygen atmosphere so as to obtain the mixed powders. The resultant mixed powders were molded in the applied magnetic field of 1.2 MA/m under a molding pressure of 120 MPa to obtain a molded body. The obtained molded body was kept in vacuum at 1040° C. for 4 hours and then was sintered. Thereafter, a sintered body was obtained after an aging treatment under Ar atmosphere. The aging treatment continued for 1.5 hours at 550° C.

TABLE 1

| | | Composition (mass %) | | | | | | | | Mass |
|---|---|---|---|---|---|---|---|---|---|---|
| | | Nd | Dy | Co | Al | Cu | B | C | Fe | ratio |
| Example 1 | First alloy 1 | 29.59 | 0.24 | 0.50 | 0.20 | 0.02 | 1.00 | 0.00 | bal. | 99.70 |
| | Second alloy 1 | 0.00 | 85.65 | 0.00 | 0.00 | 14.35 | 0.00 | 0.00 | 0.00 | 0.30 |
| | Magnet composition | 29.50 | 0.50 | 0.50 | 0.20 | 0.06 | 1.00 | 0.00 | bal. | |

Examples 2 to 4 and Comparative Examples 1 and 2

In Examples 2 to 4 and Comparative Examples 1 and 2, sintered bodies was produced as in Example 1 except that the first alloys 2 to 4 and 10 to 11 (whose compositions were similar to that of the first alloy 1) were used and the mass ratios of the alloy powders to be mixed were changed. Table 2 to Table 6 showed the compositions of the first alloys 2-4, 10 and 11 and the second alloy 1, the mixing ratio of the alloys and the magnet composition of the obtained Nd—Fe—B based sintered magnets.

TABLE 2

| | | Composition (mass %) | | | | | | | | Mass |
|---|---|---|---|---|---|---|---|---|---|---|
| | | Nd | Dy | Co | Al | Cu | B | C | Fe | ratio |
| Example 2 | First alloy 2 | 29.56 | 0.33 | 0.50 | 0.20 | 0.03 | 1.00 | 0.00 | bal. | 99.80 |
| | Second alloy 1 | 0.00 | 85.65 | 0.00 | 0.00 | 14.35 | 0.00 | 0.00 | 0.00 | 0.20 |
| | Magnet composition | 29.50 | 0.50 | 0.50 | 0.20 | 0.06 | 1.00 | 0.00 | bal. | |

TABLE 3

| | | Composition (mass %) | | | | | | | | Mass |
|---|---|---|---|---|---|---|---|---|---|---|
| | | Nd | Dy | Co | Al | Cu | B | C | Fe | ratio |
| Example 3 | First alloy 3 | 29.53 | 0.41 | 0.50 | 0.20 | 0.05 | 1.00 | 0.00 | bal. | 99.90 |
| | Second alloy 1 | 0.00 | 85.65 | 0.00 | 0.00 | 14.35 | 0.00 | 0.00 | 0.00 | 0.10 |
| | Magnet composition | 29.50 | 0.50 | 0.50 | 0.20 | 0.06 | 1.00 | 0.00 | bal. | |

TABLE 4

| | | Composition (mass %) | | | | | | | | Mass |
|---|---|---|---|---|---|---|---|---|---|---|
| | | Nd | Dy | Co | Al | Cu | B | C | Fe | ratio |
| Example 4 | First alloy 4 | 29.60 | 0.16 | 0.50 | 0.20 | 0.00 | 1.00 | 0.00 | bal. | 99.60 |
| | Second alloy 1 | 0.00 | 85.65 | 0.00 | 0.00 | 14.35 | 0.00 | 0.00 | 0.00 | 0.40 |
| | Magnet composition | 29.50 | 0.50 | 0.50 | 0.20 | 0.06 | 1.00 | 0.00 | bal. | |

TABLE 5

| | | Composition (mass %) | | | | | | | | Mass |
|---|---|---|---|---|---|---|---|---|---|---|
| | | Nd | Dy | Co | Al | Cu | B | C | Fe | ratio |
| Comparative Example 1 | First alloy 10 | 29.51 | 0.46 | 0.50 | 0.20 | 0.05 | 1.00 | 0.00 | bal. | 99.95 |
| | Second alloy 1 | 0.00 | 85.65 | 0.00 | 0.00 | 14.35 | 0.00 | 0.00 | 0.00 | 0.05 |
| | Magnet composition | 29.50 | 0.50 | 0.50 | 0.20 | 0.06 | 1.00 | 0.00 | bal. | |

TABLE 6

| | | Composition (mass %) | | | | | | | | Mass |
|---|---|---|---|---|---|---|---|---|---|---|
| | | Nd | Dy | Co | Al | Cu | B | C | Fe | ratio |
| Comparative Example 2 | First alloy 11 | 29.66 | 0.03 | 0.50 | 0.20 | 0.00 | 1.00 | 0.00 | bal. | 99.55 |
| | Second alloy 1 | 0.00 | 85.65 | 0.00 | 0.00 | 14.35 | 0.00 | 0.00 | 0.00 | 0.45 |
| | Magnet composition | 29.50 | 0.50 | 0.50 | 0.20 | 0.06 | 1.00 | 0.00 | bal. | |

Examples 5 to 7 and Comparative Example 3

In Examples 5 to 7 and Comparative Example 3, sintered bodies was produced as in Example 1 except that the first alloys 5 to 7 and 12 (whose compositions were similar to that of the first alloy 1) were used to make the magnet compositions different from that in Example 1. Table 7 to Table 10 showed the compositions of the first alloys 5-7 and 12 and the second alloy 1, the mixing ratio of the alloys and the magnet compositions of the obtained Nd—Fe—B based sintered magnets.

TABLE 7

| | | Composition (mass %) | | | | | | | | Mass |
|---|---|---|---|---|---|---|---|---|---|---|
| | | Nd | Dy | Co | Al | Cu | B | C | Fe | ratio |
| Example 5 | First alloy 5 | 30.09 | 0.24 | 0.55 | 0.20 | 0.02 | 1.00 | 0.00 | bal. | 99.70 |
| | Second alloy 1 | 0.00 | 85.65 | 0.00 | 0.00 | 14.35 | 0.00 | 0.00 | 0.00 | 0.30 |
| | Magnet composition | 30.00 | 0.50 | 0.55 | 0.20 | 0.06 | 1.00 | 0.00 | bal. | |

TABLE 8

| | | Composition (mass %) | | | | | | | | Mass |
|---|---|---|---|---|---|---|---|---|---|---|
| | | Nd | Dy | Co | Al | Cu | B | C | Fe | ratio |
| Example 6 | First alloy 6 | 29.59 | 0.24 | 0.50 | 0.20 | 0.02 | 0.97 | 0.02 | bal. | 99.70 |
| | Second alloy 1 | 0.00 | 85.65 | 0.00 | 0.00 | 14.35 | 0.00 | 0.00 | 0.00 | 0.30 |
| | Magnet composition | 29.50 | 0.50 | 0.50 | 0.20 | 0.06 | 0.97 | 0.02 | bal. | |

TABLE 9

| | | Composition (mass %) | | | | | | | | Mass |
|---|---|---|---|---|---|---|---|---|---|---|
| | | Nd | Dy | Co | Al | Cu | B | C | Fe | ratio |
| Example 7 | First alloy 7 | 30.09 | 0.24 | 0.50 | 0.20 | 0.02 | 0.99 | 0.00 | bal. | 99.70 |
| | Second alloy 1 | 0.00 | 85.65 | 0.00 | 0.00 | 14.35 | 0.00 | 0.00 | 0.00 | 0.30 |
| | Magnet composition | 30.09 | 0.50 | 0.50 | 0.20 | 0.06 | 0.99 | 0.00 | bal. | |

TABLE 10

| | | Composition (mass %) | | | | | | | | Mass |
|---|---|---|---|---|---|---|---|---|---|---|
| | | Nd | Dy | Co | Al | Cu | B | C | Fe | ratio |
| Comparative Example 3 | First alloy 12 | 29.59 | 0.24 | 0.50 | 0.20 | 0.02 | 0.88 | 0.00 | bal. | 99.70 |
| | Second alloy 1 | 0.00 | 85.65 | 0.00 | 0.00 | 14.35 | 0.00 | 0.00 | 0.00 | 0.30 |
| | Magnet composition | 29.50 | 0.50 | 0.50 | 0.20 | 0.06 | 1.00 | 0.00 | bal. | |

Examples 8 and 9

In Examples 8 and 9, sintered bodies was produced as in Example 4 except that the first alloy 4 and the second alloys 2 and 3 (which were different to the second alloy 1 in composition) were used to make the magnet compositions different from that in Example 4. Table 11 and Table 12 showed the compositions of the first alloy 4 and the second alloys 2 and 3, the mixing ratio of the alloys and the magnet compositions of the obtained Nd—Fe—B based sintered magnets.

TABLE 11

| | | Composition (mass %) | | | | | | | | Mass |
|---|---|---|---|---|---|---|---|---|---|---|
| | | Nd | Dy | Co | Al | Cu | B | C | Fe | ratio |
| Example 8 | First alloy 4 | 29.60 | 0.16 | 0.50 | 0.20 | 0.00 | 1.00 | 0.00 | bal. | 99.60 |
| | Second alloy 2 | 0.00 | 87.00 | 0.00 | 0.00 | 13.00 | 0.00 | 0.00 | 0.00 | 0.40 |
| | Magnet composition | 29.50 | 0.50 | 0.50 | 0.20 | 0.06 | 1.00 | 0.00 | bal. | |

TABLE 12

| | | Composition (mass %) | | | | | | | | Mass |
|---|---|---|---|---|---|---|---|---|---|---|
| | | Nd | Dy | Co | Al | Cu | B | C | Fe | ratio |
| Example 9 | First alloy 4 | 29.60 | 0.16 | 0.50 | 0.20 | 0.00 | 1.00 | 0.00 | bal. | 99.60 |
| | Second alloy 3 | 0.00 | 88.50 | 0.00 | 0.00 | 11.50 | 0.00 | 0.00 | 0.00 | 0.40 |
| | Magnet composition | 29.50 | 0.50 | 0.50 | 0.20 | 0.06 | 1.00 | 0.00 | bal. | |

Example 10

In Example 10, a sintered body was produced as in Example 1 except that a first alloy 8 obtained by respectively changing Nd and Dy in the first alloy 1 into Pr and Tb and the second alloy 4 obtained by changing Dy in the second alloy 1 into Tb were used. Table 13 showed the compositions of the first alloy 8 and the second alloy 4, the mixing ratio of the alloys and the magnet composition of the obtained Nd—Fe—B based sintered magnet.

TABLE 13

| | | Composition (mass %) | | | | | | | | Mass |
|---|---|---|---|---|---|---|---|---|---|---|
| | | Pr | Tb | Co | Al | Cu | B | C | Fe | ratio |
| Example 10 | First alloy 8 | 29.59 | 0.24 | 0.50 | 0.20 | 0.02 | 1.00 | 0.00 | bal. | 99.70 |
| | Second alloy 4 | 0.00 | 85.65 | 0.00 | 0.00 | 14.35 | 0.00 | 0.00 | 0.00 | 0.30 |
| | Magnet composition | 29.50 | 0.50 | 0.50 | 0.20 | 0.06 | 1.00 | 0.00 | bal. | |

Example 11 and Comparative Examples 4 to 6

In Example 11 and Comparative Examples 4 to 6, sintered bodies were produced as in Example 1 except that the first alloys 9 and 13-15 (whose compositions were similar to that of the first alloy 1) and the second alloys 5-8 (which were different to the second alloy 1 in composition) were used. Table 14 to Table 17 showed the compositions of the first alloy 9 and 13-15 and the second alloy 5-8, the mixing ratio and the magnet compositions of the obtained Nd—Fe—B based sintered magnets.

TABLE 14

| | | Composition (mass %) | | | | | | | | | Mass |
|---|---|---|---|---|---|---|---|---|---|---|---|
| | | Nd | Dy | Tb | Co | Al | Cu | B | C | Fe | ratio |
| Example 11 | First alloy 9 | 29.59 | 0.24 | 0.00 | 0.50 | 0.20 | 0.06 | 0.97 | 0.00 | bal. | 99.70 |
| | Second alloy 5 | 0.00 | 0.00 | 88.50 | 0.00 | 0.00 | 0.00 | 11.50 | 0.00 | 0.00 | 0.30 |
| | Magnet composition | 29.50 | 0.24 | 0.00 | 0.50 | 0.20 | 0.06 | 1.00 | 0.00 | bal. | |

TABLE 15

| | | Composition (mass %) | | | | | | | | Mass |
|---|---|---|---|---|---|---|---|---|---|---|
| | | Nd | Dy | Co | Al | Cu | B | C | Fe | ratio |
| Comparative Example 4 | First alloy 13 | 29.59 | 0.24 | 0.50 | 0.19 | 0.03 | 1.00 | 0.00 | bal. | 99.70 |
| | Second alloy 6 | 0.00 | 85.65 | 0.00 | 4.35 | 10.00 | 0.00 | 0.00 | 0.00 | 0.30 |
| | Magnet composition | 29.50 | 0.50 | 0.50 | 0.20 | 0.06 | 1.00 | 0.00 | bal. | |

TABLE 16

| | | Composition (mass %) | | | | | | | | Mass |
|---|---|---|---|---|---|---|---|---|---|---|
| | | Nd | Dy | Co | Al | Cu | B | C | Fe | ratio |
| Comparative Example 5 | First alloy 14 | 29.47 | 0.36 | 0.50 | 0.20 | 0.02 | 1.00 | 0.00 | bal. | 99.70 |
| | Second alloy 7 | 40.00 | 45.65 | 0.00 | 0.00 | 14.35 | 0.00 | 0.00 | 0.00 | 0.30 |
| | Magnet composition | 29.50 | 0.50 | 0.50 | 0.20 | 0.06 | 1.00 | 0.00 | bal. | |

TABLE 17

| | | Composition (mass %) | | | | | | | | Mass |
|---|---|---|---|---|---|---|---|---|---|---|
| | | Nd | Dy | Co | Al | Cu | B | C | Fe | ratio |
| Comparative Example 6 | First alloy 15 | 29.59 | 0.24 | 0.50 | 0.20 | 0.06 | 1.00 | 0.00 | bal. | 99.70 |
| | Second alloy 8 | 0.00 | 85.65 | 0.00 | 0.00 | 0.00 | 0.00 | 0.00 | bal. | 0.30 |
| | Magnet composition | 29.50 | 0.50 | 0.50 | 0.20 | 0.06 | 1.00 | 0.00 | bal. | |

Comparative Example 7

In Comparative Example 7, a sintered body was produced as in Example 1 except that the first alloy 16 (whose composition was similar to that of the first alloy 1 used in Example 1) was used without the second alloy. Table 18 showed the composition of the first alloy 16 and the magnet composition of the obtained Nd—Fe—B based sintered magnet.

TABLE 18

| | | Composition (mass %) | | | | | | | | Mass |
|---|---|---|---|---|---|---|---|---|---|---|
| | | Nd | Dy | Co | Al | Cu | B | C | Fe | ratio |
| Comparative Example 7 | First alloy 16 | 29.50 | 0.50 | 0.50 | 0.20 | 0.06 | 1.00 | 0.00 | bal. | 100.00 |
| | — | 0.00 | 0.00 | 0.00 | 0.00 | 0.00 | 0.00 | 0.00 | 0.00 | 0.00 |
| | Magnet composition | 29.50 | 0.50 | 0.50 | 0.20 | 0.06 | 1.00 | 0.00 | bal. | |

With respect to the alloys used in Examples 1 to 11 and Comparative Examples 1 to 7, the first alloys 1-16 and the second alloys 1-8, their melting points were respectively measured by using a device for DTA (differential thermal analysis). The results were shown in Table 19. In addition, as for the second alloy 5, there was no peak representing the melting point even at the maximum measuring temperature of 1300° C. of the device.

TABLE 19

| | Liquid-phase generating temperature of the first alloy (° C.) | Liquid-phase generating temperature of the second alloy (° C.) |
|---|---|---|
| Example 1 | 661 | 788 |
| Example 2 | 665 | 788 |
| Example 3 | 664 | 788 |
| Example 4 | 660 | 788 |
| Example 5 | 673 | 788 |
| Example 6 | 681 | 788 |
| Example 7 | 672 | 788 |
| Example 8 | 660 | 864 |
| Example 9 | 660 | 945 |
| Example 10 | 639 | 763 |
| Example 11 | 674 | >1300 |
| Comparative Example 1 | 668 | 788 |
| Comparative Example 2 | 657 | 788 |
| Comparative Example 3 | 692 | 788 |
| Comparative Example 4 | 662 | 712 |
| Comparative Example 5 | 666 | 663 |
| Comparative Example 6 | 662 | 932 |
| Comparative Example 7 | 667 | — |

[Structure Observation, Element Mapping and Point Analysis]

(Stem-EDS and EPMA)

The STEM-EDS (Scanning transmission electronic microscope—Energy-dispersive X-ray spectroscopy) was used to have an element mapping and a structure observation of the grain boundary triple point in the rare earth based sintered magnets of Examples 1 to 11 and Comparative Examples 1 to 7. With respect to each Example and Comparative Example, the element mapping of Nd and Pr as LR, and Dy and Tb as HR were used to determine the R-rich phases. The point analysis of R-rich phases was conducted to calculate the composition ratio of (Fe+Co)/(LR+HR+Fe+Co) and HR/(LR+HR) in R-rich phases based on the atom numbers. Table 20 showed the atomic ratio (Fe+Co)/(LR+HR+Fe+Co) and HR/(LR+HR) in the R-rich phases calculated from the results of point analysis in Examples 1 to 11 and Comparative Examples 1 to 7. In addition, based on the above-mentioned composition analysis and mapping results, the percentage of the area of the R-rich phases satisfying the composition ratio of (Fe+Co)/(LR+HR+Fe+Co)≤0.2 and HR/(LR+HR)≥0.01 in that of the grain boundary triple points was regarded as area ratio and was also shown in Table 20. Then, with respect to the rare earth based sintered magnets of Examples 1 to 11 and Comparative Examples 1 to 7, EPMA (an electron probe microanalyzer) was used to perform the element mapping in a visual field which was 25 μm×25 μm in size and was 100 μm away from the surface of the magnet. Table 20 also showed the CV values (obtained by dividing the standard deviation of all analysis points by the arithmetic mean of all analysis points) of the detection signals of Dy and Tb (which both were HR) calculated from the element mapping results of Examples 1 to 11 and Comparative Examples 1 to 7.

TABLE 20

| | (Fe + Co)/(Fe + Co + LR + HR) | HR/(LR + HR) | Area ratio (%) | CV value |
|---|---|---|---|---|
| Example 1 | 0.03 | 0.092 | 76.5 | 0.316 |
| Example 2 | 0.03 | 0.113 | 36.2 | 0.302 |
| Example 3 | 0.02 | 0.132 | 13.8 | 0.299 |
| Example 4 | 0.04 | 0.078 | 88.1 | 0.320 |
| Example 5 | 0.05 | 0.061 | 33.0 | 0.288 |
| Example 6 | 0.11 | 0.056 | 24.2 | 0.275 |
| Example 7 | 0.17 | 0.044 | 29.5 | 0.292 |
| Example 8 | 0.05 | 0.507 | 79.4 | 0.339 |
| Example 9 | 0.05 | 0.913 | 85.0 | 0.344 |
| Example 10 | 0.04 | 0.107 | 66.9 | 0.330 |
| Example 11 | 0.11 | 0.030 | 15.3 | 0.524 |
| Comparative Example 1 | 0.06 | 0.102 | 7.6 | 0.253 |
| Comparative Example 2 | 0.04 | 0.115 | 93.8 | 0.429 |
| Comparative Example 3 | 0.15 | 0.090 | 6.8 | 0.199 |
| Comparative Example 4 | 0.32 | 0.034 | 20.9 | 0.275 |
| Comparative Example 5 | 0.04 | 0.008 | 12.1 | 0.263 |
| Comparative Example 6 | 0.23 | 0.027 | 32.0 | 0.259 |
| Comparative Example 7 | 0.09 | 0.017 | 23.0 | 0.144 |

[Evaluation]

[Evaluation of Corrosion Resistance and Magnetic Properties]

The sample obtained by etching the surface of the rare earth based sintered magnet for 2 minutes with a solution of 5 vol % nitric acid-ethanol was corroded with a PCT tester (Pressure Cooker Test) at 120° C. under 2 atm and 100% RH. The corrosive product was removed from the surface of the magnet, and test results of the rate of mass reduction of the rare earth based sintered magnet were shown in FIG. 3. In addition, the magnetic properties of each rare earth based sintered magnet in Examples 1 to 11 and Comparative Examples 1 to 7 were tested by a BH tracer. Table 21 showed the measured residual flux density Br and coercivity HcJ of each rare earth based sintered magnet.

TABLE 21

| | Br (mT) | HcJ (kA/m) |
|---|---|---|
| Example 1 | 1409 | 1012 |
| Example 2 | 1409 | 1010 |
| Example 3 | 1407 | 1023 |
| Example 4 | 1412 | 1005 |
| Example 5 | 1401 | 1024 |
| Example 6 | 1400 | 1033 |
| Example 7 | 1402 | 1028 |
| Example 8 | 1404 | 1030 |
| Example 9 | 1401 | 1043 |
| Example 10 | 1400 | 1072 |
| Example 11 | 1400 | 965 |
| Comparative Example 1 | 1406 | 1025 |
| Comparative Example 2 | 1387 | 1019 |
| Comparative Example 3 | 1069 | 1005 |
| Comparative Example 4 | 1403 | 948 |
| Comparative Example 5 | 1400 | 1001 |
| Comparative Example 6 | 1405 | 940 |
| Comparative Example 7 | 1401 | 1008 |

It could be known from Tables 20 and 21 that in Comparative Example 3, the area ratio of the region with HR/(LR+HR)≤0.01 was as low as 6.8% at the grain boundary triple points which contained R-rich phases with (Fe+Co)/(LR+HR+Fe+Co)≤0.2 based on atomic ratio. In addition, it could be seen that as in Comparative Example 2, when such an area ratio was up to 93.8%, Br was small. Further, in Comparative Example 4 and Comparative Example 6, the atomic ratio of (Fe+Co)/(LR+HR+Fe+Co) was respectively 0.32 and 0.23 which were larger than that in Example 1, and thus the coercivity in the magnetic properties reduced. Further, it could be seen from FIG. 3 that the atomic ratio of HR/(LR+HR) in Comparative Example 5 was 0.008 which was lower than that in Example 1, and thus the corrosion resistance was impaired.

In addition, according to Table 20, the concentration difference was obvious between the main phase and the part with Dy segregation in Example 1, and the CV value was 0.316. On the other hand, the concentration difference was small between the main phase and the part with Dy segregation in Comparative Example 7, and the CV value was 0.144.

Figure 3:
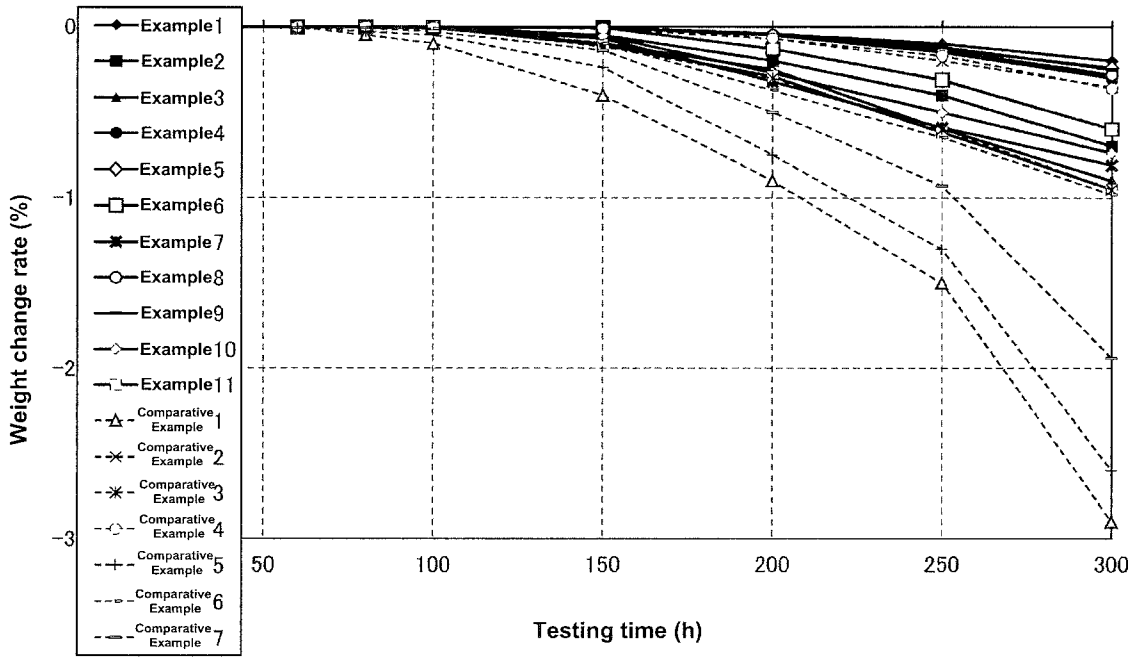
FIG. 3 is a graph showing the results of corrosion resistance test conducted by use of a PCT tester.

It could be seen from FIG. 3 that compared to Comparative Examples 1, 5 and 7, the mass changes in Examples 1 to 11 and Comparative Examples 2 to 4 and 6 were quite small and less than 1% even over 300 hours. That is, the latter ones had high corrosion resistance. In addition, it was obvious from Table 21 that Br was low in Comparative Examples 2 and 3 and HcJ was low in Comparative Examples 4 and 6 when compared to Examples 1 to 11 and Comparative Examples 1, 5 and 7.

Based on the evaluation of corrosion resistance and magnetic properties above, it can be seen that the corrosion resistance could be improved while the magnetic properties were maintained in a good state in Examples 1 to 11. It could be considered whether the following factors had effect on the corrosion resistance and the magnetic properties of the rare earth based sintered magnet, such that the atomic ratio of (Fe+Co)/(LR+HR+Fe+Co) and HR/(LR+HR) in the R-rich phases of the grain boundary triple point fell within the specified range; the area ratio of the R-rich phases in the grain boundary triple points was within the specified range; and the CV value (obtained by dividing the standard deviation of all analysis points by the arithmetic mean of all analysis points) of the detection signal of HR via EPMA in a visual filed of 10-100 μm×10-100 μm excluding the 50 μm part of the surface layer fell within the specified range. Therefore, according to the present embodiment, it was quite clear that a rare earth based sintered magnet could be produced whose the magnetic properties were not impaired and the corrosion resistance was improved.

As described above, the present invention can provide a rare earth based sintered magnet in which the magnetic properties are maintained while the corrosion resistance is improved. Thus, such a magnet can be provided as a permanent magnet used in a motor such as a voice-coil motor for head driving in hard disk drive, a motor in electric vehicle or a hybrid car, industrial equipments or household electrical goods which require corrosion resistance.

DESCRIPTION OF REFERENCE NUMERALS

1 main phase
2 grain boundary triple point
3 grain boundary phase
4 R-rich phase
5 HR-rich phase

What is claimed is:

1. A rare earth based sintered magnet, wherein, it is a rare earth based permanent magnet having a R-T-B based composition, wherein, R represents one or more elements selected from Y and rare earth elements, T represents one or more metal elements containing Fe or the combination of Fe and Co, and B represents B or the combination of B and C, a R-rich phase with the atomic ratio of (Fe+Co)/(LR+HR+Fe+Co)≤0.2 is present in the grain boundary triple point, and a region with the atomic ratio of HR/(LR+HR)≥0.01 is present in the R-rich phase and accounts for 10% to 90% of the area of the grain boundary triple point, wherein, LR represents one or more elements selected from Y and the light rare earth elements from $^{57}$La to $^{63}$Eu, and HR represents one or more elements selected from the heavy rare earth elements from $^{64}$Gd to $^{71}$Lu, said LR at least contains Nd or Pr, and said HR at least contains Dy or Tb.

2. The rare earth based sintered magnet according to claim 1, wherein, when the magnet was observed via an electron probe microanalyzer (EPMA) in a visual field of 10-100 μm×10-100 μm, the CV value of the detection signal of HR in the visual filed excluding the 50 μm part of the surface layer of the magnet ranges from 0.15 to 0.5, and the CV value is obtained by dividing the standard deviation of all analysis points by the arithmetic mean of all analysis points.

3. The rare earth based sintered magnet according to claim 1, wherein, the content of R is 25 mass % or more and 35 mass % or less, the content of B is 0.9 mass % or more and 1.1 mass % or less, and the balance is the composition substantially containing T.

4. The rare earth based sintered magnet according to claim 2, wherein, the content of R is 25 mass % or more and 35 mass % or less, the content of B is 0.9 mass % or more and 1.1 mass % or less, and the balance is the composition substantially containing T.

* * * * *